US012209315B2

(12) United States Patent
Li et al.

(10) Patent No.: US 12,209,315 B2
(45) Date of Patent: Jan. 28, 2025

(54) COMPOSITIONS AND METHODS FOR FORMING DAMAGE-RESISTANT MULTILAYERED HYDROGEN PERMEATION BARRIERS

(71) Applicant: MASSACHUSETTS INSTITUTE OF TECHNOLOGY, Cambridge, MA (US)

(72) Inventors: Ju Li, Weston, MA (US); Bilge Yildiz, Cambridge, MA (US); Cemal Cem Tasan, Cambridge, MA (US); Jinwoo Kim, Revere, MA (US); Xiahui Yao, San Jose, CA (US); Vrindaa Somjit, Cambridge, MA (US); So Yeon Kim, Cambridge, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 46 days.

(21) Appl. No.: 18/009,708

(22) PCT Filed: Jul. 29, 2021

(86) PCT No.: PCT/US2021/043793

§ 371 (c)(1),
(2) Date: Dec. 9, 2022

(87) PCT Pub. No.: WO2022/026769

PCT Pub. Date: Feb. 3, 2022

(65) Prior Publication Data

US 2023/0243040 A1 Aug. 3, 2023

Related U.S. Application Data

(60) Provisional application No. 63/058,387, filed on Jul. 29, 2020.

(51) Int. Cl.
*C23C 28/00* (2006.01)

(52) U.S. Cl.
CPC ..... *C23C 28/32* (2013.01)

(58) Field of Classification Search
None
See application file for complete search history.

(56) References Cited

FOREIGN PATENT DOCUMENTS

CN 108914111 A * 11/2018 ..... C23C 14/165
CN 109957756 A 7/2019
(Continued)

OTHER PUBLICATIONS

Machine Translation of CN-110670040-A (Year: 2020).*
(Continued)

*Primary Examiner* — Shamim Ahmed
*Assistant Examiner* — Bradford M Gates
(74) *Attorney, Agent, or Firm* — Barnes & Thornburg LLP

(57) ABSTRACT

Compositions and processes for forming barrier coatings to prevent hydrogen embrittlement of an underlying material are disclosed. The coating can be made up of composite structures of metal and oxide that are alternately deposited onto a substrate for creating a multilayer coated substrate. Such multilayer coating can be incorporated into many contexts in which hydrogen permeation prevention is desired, such as pipelines and manufacture of advanced automotive steels. The process involves depositing a metal layer onto the substrate followed by a metal oxide layer thereon. The interface of the metal layer and the oxide layer can form space-charge zones that decrease hydrogen permeability therethrough.

19 Claims, 6 Drawing Sheets

(56) References Cited

FOREIGN PATENT DOCUMENTS

| | | | | | |
|---|---|---|---|---|---|
| CN | 110670040 | A | * | 1/2020 | ..... C23C 14/0036 |
| JP | 2007009276 | A | | 1/2007 | |

OTHER PUBLICATIONS

Machine Translation of CN-108914111-A (Year: 2018).*
International Search Report and Written Opinion for Application No. PCT/US2021/043793, date of mailing Dec. 9, 2021 (12 pages).
Yamabe, J., Matsuoka, S. and Murakami, Y., 2013. Surface coating with a high resistance to hydrogen entry under high-pressure hydrogen-gas environment. International journal of hydrogen energy, 38(24), pp. 10141-10154.
Yamabe, J., Awane, T. and Matsuoka, S., 2015. Elucidating the hydrogen-entry-obstruction mechanism of a newly developed aluminum-based coating in high-pressure gaseous hydrogen. international journal of hydrogen energy, 40 (32), pp. 10329-10339.
Yamabe, J., Awane, T. and Murakami, Y., 2017. Hydrogen trapped at intermetallic particles in aluminum alloy 6061-T6 exposed to high-pressure hydrogen gas and the reason for high resistance against hydrogen embrittlement. international journal of hydrogen energy, 42(38), pp. 24560-24568.
Kim, et al., (Manuscript) Remove hydrogren and store it oo: An acid-in-clay based electro-chemical solution, Energy & Environmental Science, dated May 16, 2024 (15 pages).

* cited by examiner

COMPOSITIONS AND METHODS FOR FORMING DAMAGE-RESISTANT MULTILAYERED HYDROGEN PERMEATION BARRIERS

CROSS-REFERENCE TO RELATED CASES

This application is a U.S. national counterpart application of International Application Serial No. PCT/US2021/043707 filed Jul. 29, 2021, which claims priority to and the benefit of U.S. Provisional Application No. 63/058,387, entitled "Compositions and Methods for forming Damage-Resistant Multilayered Hydrogen Permeation Barriers," filed on Jul. 29, 2020, the disclosures of both of which are hereby expressly incorporated by reference in their entities.

FIELD

The present disclosure relates to compositions and processes for forming barrier coatings to prevent hydrogen embrittlement of an underlying material (e.g., structural metal, substrate), and more particularly relates to coatings having multilayer composite structures of metal and oxide (e.g., aluminum and aluminum oxide).

BACKGROUND

Materials such as structural metals have been used in a variety of manufacturing, testing, and development processes over the last century to create products for everyday use. Over time, as production needs and accompanying costs have increased, manufacturers began to search for ways to prolong the life of the machinery involved in these processes such that downtime can be minimized and existing parts can be used for a larger number of cycles. One such way of prolonging the life of parts was found to minimize the number of foreign elements and particulates, e.g., hydrogen, oxygen, carbon, and so forth, that the structural metals absorbed, and, in the event that absorbance took place, allow the metals to recover or heal from said absorbance.

Industries that utilize hydrogen-containing resources contacting metallic structural materials include energy industries such as natural gas pipelines and thermoelectric or nuclear power plants, automotive industries that produce advanced automotive steel and hydrogen powered cases, and/or marine industries that service offshore plans and utilize vessel steels. The machinery used in these industries experience frequent interactions with various microstructural components that can cause significant deterioration in mechanical properties of metals. High-strength steels, for example, are particularly susceptible to hydrogen embrittlement, which is seen as one of the most critical problems for advanced steels and alloys.

Conventional methods for inhibiting hydrogen ingress includes use of surface layers to physically prevent environmental hydrogen embrittlement of structural metals. These surface layers are made from oxides or nitrides with high densities, which, while having low hydrogen diffusivity that provides excellent hydrogen barrier performance, exhibit poor mechanical durability. Moreover, many conventional coatings have a porous structure that allows foreign substances like hydrogen to seep through, thereby deteriorating the structure and mechanical performances of the metal over time.

Accordingly, there is a need for an improved coating for protecting structural materials like metals from hydrogen embrittlement, along with techniques for providing such protection.

SUMMARY

The present application is directed to compositions and methods for forming barrier coatings to increase the effectiveness of hydrogen barrier performance of various materials. Barrier coatings can provide physical inhibition of hydrogen ingress as an effective way to prevent environmental hydrogen embrittlement of structural metals, and are useful for protecting metal structures in a hydrogen environment. In at least some instances, the coatings can be made of multilayer composite structures that can be sequentially applied to a material and/or a substrate to protect from the effects of hydrogen. For example, the composite structure can be formed from sequential deposition of layers of metal and oxide onto a substrate to form the multilayer structure. Interaction of the metal with the substrate, as well as the interface of the oxide and the metal, can hinder hydrogen absorption to prevent hydrogen from diffusing through the coating and damaging the underlying substrate. The composite structure of metal and oxide can also improve the damage resistance of hydrogen barrier coatings, as compared to single material hydrogen barrier coatings.

The use of these coatings to provide physical inhibition of hydrogen ingress is one exemplary type of protection of metals, such as iron, nickel, cobalt, aluminum, magnesium, titanium, zirconium, and/or their alloys, but as provided for herein, more broadly can be used to protect any parts coated therewith from delamination and/or weathering. For example, the coating can be applied to plastics, such as polyurethanes, glass, ceramics, and so forth to protect the underlying material from hydrogen permeation.

The processes provided for utilize steps of applying and/or depositing a first layer of metal onto the substrate, applying and/or depositing a layer of an oxide on top of the metal, and repeating the sequence of layering the metal and oxide to form the multilayer coating. As described herein, various parameters associated with the substrate, the coating, and the processing steps can be adjusted to produce desirable results for the coating related to one or more of blocking the permeation of hydrogen, preventing the escape of hydrogen when hydrogen is encased in the material to cause damaging structural defects, among other properties of the multilayer coating that can be controlled via the disclosed processes.

In one exemplary embodiment of a method for regulating hydrogen permeability of a substrate, the method includes contacting a substrate with a metal under conditions sufficient to form a coated substrate comprising a coating of the metal on the substrate, and contacting the coated substrate with a metal oxide under conditions sufficient to form a coating of the metal oxide on the coated substrate, thereby forming a multilayer coating on the substrate.

The method can further include contacting the multilayered coating on the substrate with a second metal under conditions to form a coating on the multilayer coating, and contacting the second metal with a second metal oxide under conditions sufficient to form a coating of the second metal oxide on the second metal. In some embodiments, the method can further include alternatively contacting the multilayered coating with a metal and a metal oxide to add alternating layers to the multilayered coating. In some embodiments, the method can further include expanding the substrate under temperature and pressure. The substrate can be expanded by one or more of thermal heating of the substrate or stress application to the substrate.

The action of contacting the substrate with the metal can be performed using a variety of techniques. These techniques include, but are not limited to, depositing the metal onto the substrate by one or more of thermal spray, cold spray, magnetron sputtering, sol-gel coating, chemical vapor deposition, slurry coating, spray-drying, atomic layered deposition, spin coating, and/or drop coating. The action of contacting the coated substrate with the metal oxide can also be performed using a variety of techniques. These techniques include, but are not limited to, depositing the metal oxide onto the substrate by one or more of thermal spray, cold spray, magnetron sputtering, sol-gel coating, chemical vapor deposition, slurry coating, spray-drying, atomic layered deposition, spin coating, and/or drop coating.

The metal oxide can be aluminum oxide. The metal can be aluminum. The metal oxide can be formed on the coated substrate by oxidizing the metal on the substrate.

In some embodiments, the multilayer coating can include one or more space-charge zones at the interfaces of the metal and the metal oxide. One or more layers of the multilayer coating can include at least one of cracks or pinholes extending therethrough, the at least one of cracks or pinholes terminating in the layer of the one or more layers.

In one exemplary embodiment of a multilayer coating, the coating includes a first layer containing a metal, the first layer configured to be deposited onto a substrate, and a second layer containing an oxide, the second oxide layer configured to be deposited onto the first metal layer. The first and second layers form one or more space-charge zones at the interface thereof, the space-charge zones being configured to trap hydrogen molecules therein to prevent permeation of the molecules through the first layer.

The metal oxide can be aluminum oxide. The metal can be aluminum. In some embodiments, the multilayer coating can include at least two layers of aluminum oxide and at least two layers of aluminum disposed in an alternating configuration. A first layer and a third layer of the multilayer coating can include aluminum, and a second layer and a fourth layer of the multilayer coating includes aluminum oxide.

In some embodiments, the coating can include a first metal layer that is configured to enter crevices formed in the substrate when deposited to increase adherence to the substrate. The combination of the first layer and the second layer can be configured to decrease permeation of hydrogen through a thickness of the coating. In some embodiments, one or more layers of the multi-layer coating can include cracks or pinholes therein, the cracks or pinholes terminating at the interfaces of the layer of the one or more layers.

BRIEF DESCRIPTION OF THE DRAWINGS

This disclosure will be more fully understood from the following detailed description taken in conjunction with the accompanying drawings, in which.

GENERAL DESCRIPTION

Figure 1B:
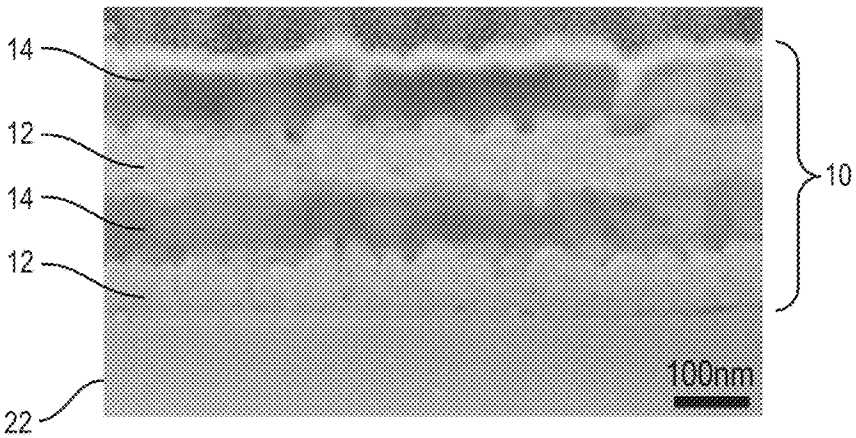
FIG. 1B is a magnified front view of a multi-layer coating of the present embodiments having alternating metal and oxide layers on ferritic stainless steel.

Certain exemplary embodiments will now be described to provide an overall understanding of the principles of the structure, function, manufacture, and use of the systems, devices, and methods disclosed herein. One or more examples of these embodiments are illustrated in the accompanying drawings. Those skilled in the art will understand that the systems, compositions, and methods specifically described herein and illustrated in the accompanying drawings are non-limiting exemplary embodiments and that the scope of the present disclosure is defined solely by the claims. The features illustrated or described in connection with one exemplary embodiment may be combined with the features of other embodiments. Such modifications and variations are intended to be included within the scope of the present disclosure.

To the extent that the instant disclosure includes various terms for components and/or processes of the disclosed devices, systems, methods, and the like, one skilled in the art, in view of the claims, present disclosure, and knowledge of the skilled person, will understand such terms are merely examples of such components and/or processes, and other components, designs, processes, and/or actions are possible. By way of non-limiting example, layers are described as being deposited or applied onto a substrate to produce a coated substrate. Such deposition can occur by one or more of thermal spray, cold spray, magnetron sputtering, sol-gel coating, chemical vapor deposition, slurry coating, spray-drying, atomic layered deposition, spin coating, or drop coating, among others. A person skilled in the art, however, in view of the present disclosures will understand other ways by which the material can be associated with the substrate. To the extent the present application describes a layer-by-layer formation of the coating on the underlying material (e.g., metal, substrate, etc.), in some embodiments the coating can be pre-formulated such that it is already in a layered configuration prior to being deposited onto the underlying material.

In some embodiments, one or more materials can be deposited onto a substrate to prevent and/or limit hydrogen diffusion through a surface thereof. Hydrogen diffusion can cause significant deterioration of mechanical properties of metals, with high strength steels being especially susceptible to hydrogen embrittlement. In natural gas pipelines or the piping in power plants, high pressures and exposure to significant mechanical and chemical stresses can increase the likelihood of hydrogen escaping therethrough, which can cause damage to the structure of the pipelines. For example, hydrogen permeation through the surface of a metal structure can induce cracking, which can cause equipment malfunctions and extended shutdowns for repair and replacement. Conventional coatings such as ceramics and nitrides cannot create and maintain a barrier needed for such pipelines to withstand cracking due to mechanical damages and/or thermal expansion of the pipelines during operation. For example, at elevated temperatures and pressures, the underlying metal structures plastically expand, while conventional coatings cannot due to their brittle nature. This can lead to cracking of the coating and portions of the pipeline being exposed to the hydrogen environment, allowing hydrogen to permeate therethrough and damage the pipeline material.

The present disclosure generally relates to the composition and formation of a coating that has specific diffusion permeation characteristics and other mechanical characteristics that reduce and/or eliminate hydrogen permeation through the coating, and thus through the material to which the coating is applied. For example, application of the coating onto pipelines and other metal structures can create a barrier which provides physical inhibition of hydrogen ingress to decrease hydrogen permeation through the coated material. Some non-limiting examples of the material can include metals such as iron, nickel, cobalt, aluminum, magnesium, titanium, zirconium, and/or their alloys, and so forth, as mentioned above, though, other substrates can include polymers, glass, ceramics, silicon, silicon oxide, and/or practically any materials that suffer from hydrogen embrittlement. Combinations of the same are also possible.

The multilayer coating of the present disclosure can allow for, among other things: (i) the metal interlayer between substrate and oxide layers to provide physical and mechanical compatibility with the underlying metal to prevent delamination of coatings during deformation; (ii) the multiple oxide/metal interfaces to trap hydrogen and reduce hydrogen permeability even further than a monolithic coating; and (iii) the strong micro-cracking resistance and self-healing capability of the composite structure by natural oxidation of a material like aluminum to enable the hydrogen barrier performance to be retained even after mechanical damaging, i.e., the coating can be self-healing.

One exemplary embodiment of a coating includes one or more multilayer composite structures of metal and oxide, e.g., aluminum (Al) and aluminum oxide ($Al_2O_3$), respectively. The composite structures can be laid in sequence, e.g., one on top of the other, to create a multilayer coating. In some embodiments, the coating can be formed by depositing a metal layer on the substrate. The metal layer can exhibit physical and mechanical compatibility with the underlying substrate to prevent delamination. For example, the metal layer can provide strong adhesion between the substrate and the coating at the interface by filling the crevices of the substrate, thereby preventing delamination of the coating from the surface of the substrate. While the metal layer can be made of aluminum, a person skilled in the art will recognize that some non-limiting examples of the metal layer can include chromium, zirconium, erbium and/or yttrium, which forms a natural oxide layer with a low hydrogen diffusion coefficient lower than $10^{-16}$ $m^2/s$.

Figure 1A:
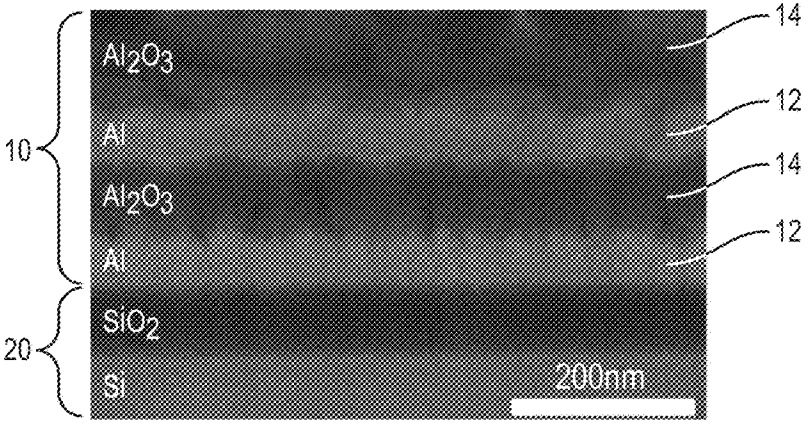
FIG. 1A is a magnified front view of a multi-layer coating of the present embodiments having alternating metal and oxide layers on a silicon oxide-silicon substrate.

The oxide layer can then be deposited onto the metal layer to form the multi-layer coating. Aluminum oxide can be used in the oxide layer due to its low hydrogen solubility and diffusivity, as well as its high irreducibility. It will be appreciated that the oxide layer can be made up of a metal layer that has been oxidized. The interface of the metal layer and the oxide layer can form space-charge zones that decrease hydrogen permeability therethrough. For example, the formation of extended space-charge zones at the oxide/metal interface can repel positively charged species. In the case of hydrogen, which dissolves as protons in an oxide, these space charge zones have the potential to prevent and/or limit the entry of hydrogen, thereby minimizing damage to the underlying substrate. While aluminum oxide is discussed herein as the oxide layer, some additional non-limiting examples of the oxide layer can include chromium oxide, zirconium oxide, erbium oxide, and/or yttrium oxide. It will be appreciated that aluminum oxide (AO) is discussed herein as comprising the oxide layer due to aluminum (Al) comprising the metal layer. Use of the same metal that is in the metal layer in the oxide layer enhances adhesion between metal and oxide layers and helps provide the self-healing of the present disclosure. FIGS. 1A and 1B illustrate an exemplary embodiment of the multilayer coating 10 that results from the deposition of layers discussed above, on a silicon oxide-silicon substrate and a ferritic stainless steel substrate, respectively. As shown, the coating 10 can include the metal layer 12 disposed on the substrate 20 with the oxide layer 14 disposed thereon. This layering of the metal layer 12 and the oxide layer 14 can be repeated to produce the quad-layer AO—Al—AO—Al hydrogen barrier coating discussed above. Other layer configurations that align with the present disclosures can also be produced.

In some embodiments, the metal layer can be oxidized to be self-healing. A person skilled in the art will recognize that self-healing refers to the ability of the coating to sustain hydrogen barrier properties even after the coating has been damaged. When the underlying substrate is subjected to mechanical forces, such as stresses and strains, or increased temperatures or pressures, the substrate can expand and/or deform. Expansion of the substrate can cause the coating deposited thereon to become damaged. The multilayer coating of the present disclosure exhibits self-healing properties that allow the coating to maintain its hydrogen barrier properties even after being damaged. For example, despite exhibiting cracking or thinning of the coating when the substrate is stressed, the multilayer coating can prevent, and in some cases even improve, hydrogen permeation therethrough. The self-healing properties of the coating of the instant disclosure can be attributed to the aluminum oxide. Aluminum oxide is a native oxide of Al, and thus the presence of Al can lend self-healing properties to the coating in the event of cracking or spallation. Aluminum oxide and aluminum also have the lowest hydrogen permeability amongst oxides and metals respectively, further enhancing the coating's hydrogen barrier properties. Specifically, the formation and migration energies of hydrogen in aluminum oxide is the highest among other candidate hydrogen barrier materials as calculated using density functional theory (DFT), which are linked to its low hydrogen solubility and diffusivity, respectively, which is shown in greater detail in Table 1 below.

TABLE 1

| | Formation energy (eV) | Migration energy (eV) |
|---|---|---|
| Al2O3 | 2.6 | 1.25 |
| Er2O3 | 2.22 | 1.64 |
| TiC | 0.84 | 0.47 |
| SiC | 0.48 | 1.0 |

In some embodiments, the multilayer coating can withstand higher onset strain for tensile cracking at a bent surface of the substrate as compared to a single layer coating, with no delamination exhibited upon bending of the underlying substrate.

The use of aluminum oxide in the multilayer coating of the present embodiments in place of conventional aluminum coatings, such as aluminum nitride (AlN) and/or aluminum alloys such as aluminum titanium (Al—Ti) alloys, creates space-charge zones with the metal layer to repel hydrogen from permeating. These space-charge zones, as well as the self-healing properties exhibited by the multilayer coating, do not generally occur in films made with only a single material such as aluminum oxides and nitrides. The space-charge zones formed at the interface of the alternating layers of aluminum and aluminum oxide reduce hydrogen levels near the interface by segregating hydrogen protons within the coating to prevent travel of the hydrogen into the substrate. The presence of alternating metal layers between oxide layers provides mechanical compatibility with the underlying steel, preventing crack propagation across the interface, as described further below. Moreover, the metal layer can provide improved resistance to coating delamination when it is deposited on the substrate as the first layer, due to stronger bonding between the metal layer and the metal substrate, as compared to bonding between the oxide layer and the substrate. Most of the multilayer candidates in literature are combinations of oxides, which may not provide the mechanical durability required for room temperature applications.

Figure 2:
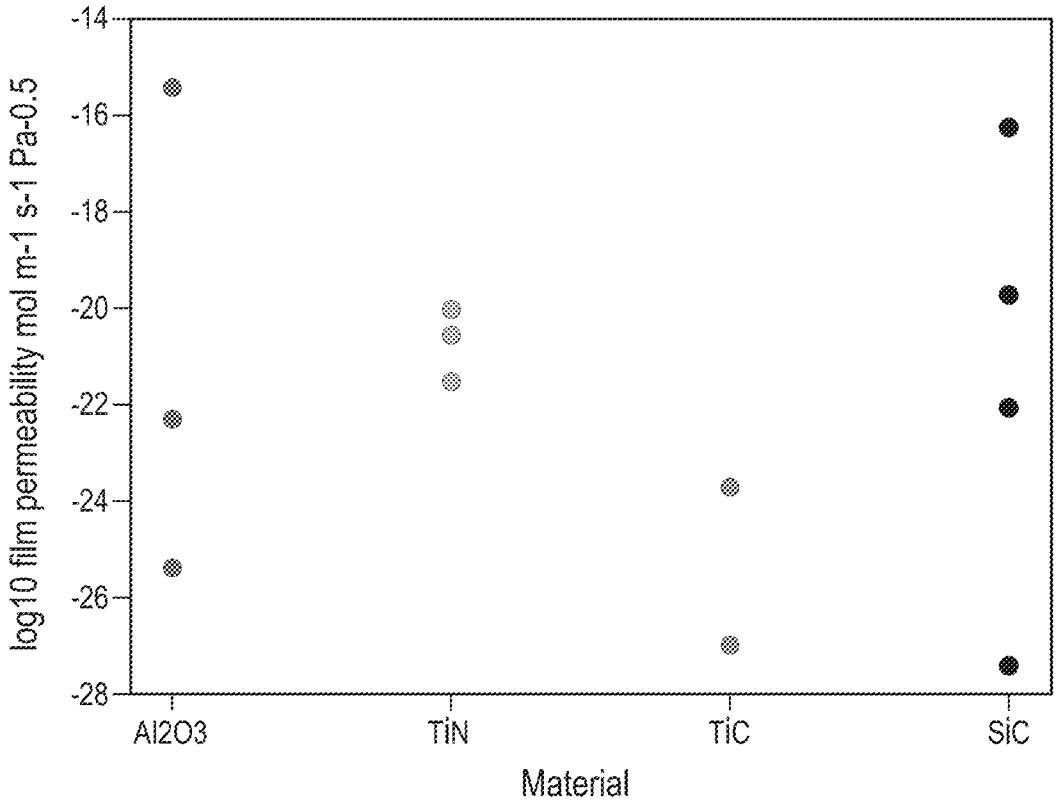
FIG. 2 (PRIOR ART)
FIG. 2 is a graph illustrating hydrogen permeability for various ceramic-based hydrogen barrier candidates in the prior art.

The hydrogen barrier properties of $Al_2O_3$-based coatings can be severely degraded by cracking, spalling, and pinholes in the $Al_2O_3$ layer. In particular, the issue of cracks and pinholes is reflected in the large scatter in the hydrogen permeability reported in literature for various ceramic-based hydrogen barrier candidates. This is depicted in FIG. 2, where the room temperature hydrogen permeability of $Al_2O_3$ (extrapolated from high temperature measurements) varies by over 10 orders of magnitude, thereby highlighting the importance of coating integrity on hydrogen barrier performance. As shown in FIG. 1, alternating layers of aluminum and aluminum oxide, as discussed above is an effective strategy to prevent interconnected pinholes, as each sublayer acts as a "termination" layer when the next material is deposited. For example, the alternating metal and metal oxide layers isolate the cracks and pinholes formed within each layer from one another to prevent formation of continuous passages through which the hydrogen can travel. Isolating the cracks and pinholes to prevent them from interconnecting can trap the hydrogen at the metal/oxide interfaces and prevent it from permeating through the layers and degrading the underlying substrate.

Figure 3:
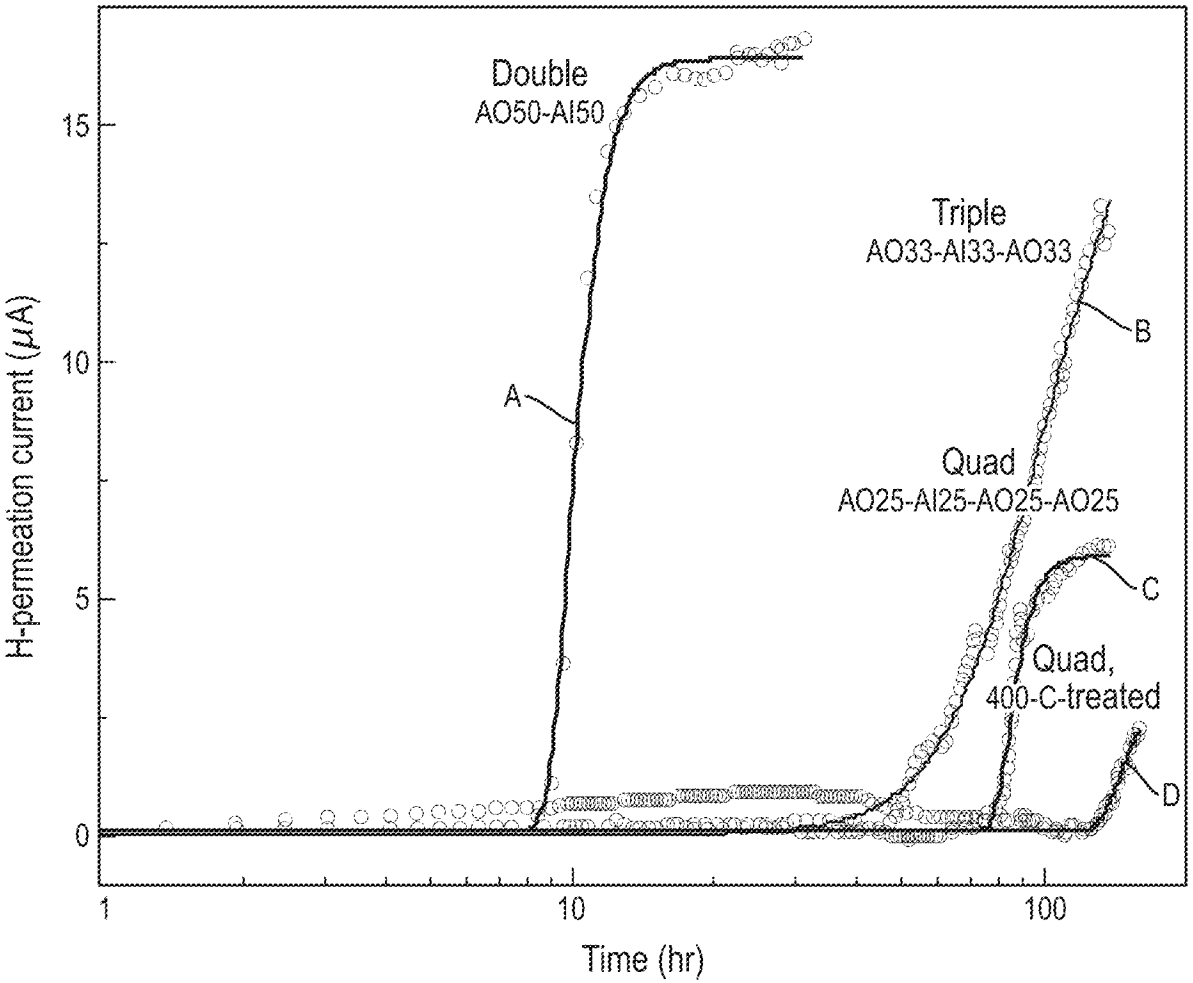
FIG. 3 is a graph illustrating hydrogen permeation current in the multi-layer coatings having different numbers of alternating metal and oxide layers on a ferritic stainless steel.

Permeation reduction can be a function of the number of layers of metal and metal oxides in the multilayer coating. As shown in FIG. 3, for example, in some embodiments, increasing the number of oxide/metal interfaces can increase the effectiveness of the coating for preventing permeation of hydrogen therethrough. The hydrogen permeation through the specimens can be measured electrochemically using a Devanathan-Stachurski cell. Hydrogen can be charged into the coating surface electrochemically, and the hydrogen permeation current can be measured on the other surface of the specimen (i.e., on the substrate surface) electrochemically. As shown in FIG. 3, hydrogen permeation current represents the amount of detected hydrogen permeation. The onset of a significant increase in the H-permeation current signal (e.g., at approximately 10 hours in line A, at approximately 50 hours in line B, at approximately 80 hours in line C, and at approximately 105 hours in line D) represents that hydrogen has permeated completely through the coating and the substrate after hydrogen ingress at that time, and hydrogen permeation starts to be detected. A larger onset time of the H-permeation current increase represents a lower hydrogen diffusivity, or a higher hydrogen barrier performance. In some embodiments, the multilayer coating can include four layers—two layers of metal that alternate with two layers of metal oxide. In such an arrangement, the multilayer coating can include three metal/oxide interfaces that enhance the permeation of hydrogen therethrough. A person skilled in the art will recognize that the multilayer coating can include five or more alternating layers, which can also improve hydrogen permeation.

Permeation reduction when using multiple layers can be attributed to the DFT-calculated formation energy of hydrogen. For example, the DFT-calculated formation energy of hydrogen in aluminum is also very high (~0.7 eV), giving rise to its low hydrogen solubility. Additionally, the segregation energy of hydrogen to the $Al_2O_3$|Al interface is approximately −6 eV and approximately −4 eV for $Al_2O_3$ and Al respectively, indicating that hydrogen segregates favorably to the interface and is trapped at said interface, which further highlights that increasing the number of interfaces (at the same overall coating thickness) enhances hydrogen barrier performance.

The strong micro-cracking resistance and the self-healing potential of the composite structure of the present disclosure enables the structure to retain hydrogen barrier performance even after sustaining mechanical damage. By using alternating layers of AlO and Al, the multilayer coating exhibits several advantages over prior art coatings that are based on a single layer coating, such as improved cracking resistance, strong adhesion between the substrate and coating due to aluminum interlayers, and self-healing properties. Moreover, the coating exhibits low hydrogen permeation in its as-deposited state. In some embodiments, hydrogen barrier performance of the multi-layer coating can be retained after bending deformation.

The coatings resulting from the present disclosure can be used to coat various materials to prevent environmental hydrogen embrittlement. Either separately, or as part of an overall manufacturing process, the coating can be incorporated into a variety of structural metals (e.g., steel, iron, stainless steel, and so forth) where deterioration and/or embrittlement of materials (e.g., structural metals) is desirable, which can include applications where prevention of escape of hydrogen is desired, or hydrogen exists outside of a system and its entry into the system would have deleterious consequences. By way of non-limiting examples, such coatings can be incorporated into: a shell of an airplane (i.e., the combination of the fuselage, wings, and horizontal and vertical stabilizers); the housings, exteriors, and/or related components of other modes of transportation; advanced automotive steels (e.g., head and tail lights of a vehicle or other mode of transportation); hydrogen-powered cars; offshore plants and vessel steels; factory equipment, such as natural gas pipelines, thermoelectric and/or nuclear power plants, pipes, and heat exchangers. Such usages are a result of the preventative nature of the resulting films that allow upkeep of materials coated therewith to prevent degradation and/or cracking, among other benefits afforded by the present disclosures. Cracking processes in Al-AO multilayer hydrogen barrier coatings are described in greater detail below.

Figure 4:
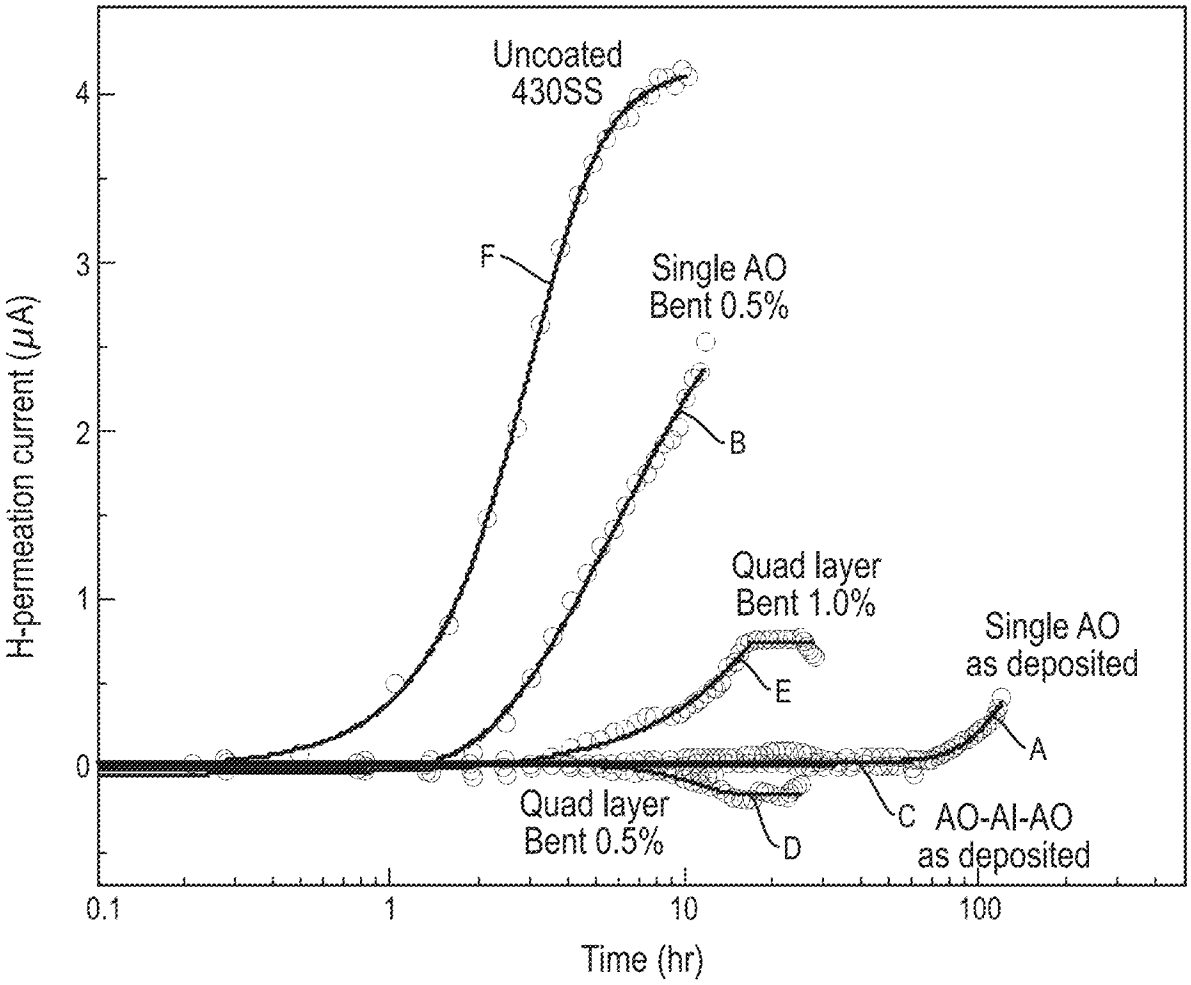
FIG. 4 is a graph illustrating hydrogen permeation current in the multi-layer coating of the present embodiments as compared to other coatings, before and after bending.

The quad-layer coating of alternating layers of aluminum and aluminum oxide retains high hydrogen barrier performance even after deformation. FIG. 4 illustrates a comparison of a single AO coating and a quad-layer AO—Al—AO—Al coating, before and after bending deformation, measuring a hydrogen-permeation current that passes therethrough. As shown, the single oxide layer coatings exhibit a drastic decrease of the permeation onset time after bending to 0.5% strain (decrease from approximately 80 hours of A to approximately 2 hours of B). In contrast, the multi-layer coating does not show a clear permeation current signal for up to 30 hours even after bending to 0.5% strain (D) and exhibits a higher permeation onset time of approximately 4 hours even after bending to 0.5% strain (E). The multi-layer coating of the present embodiments therefore maintains high hydrogen barrier performance therethrough, which can serve to prolong the life of the coated substrate beneath by shielding the substrate.

Figure 5A:
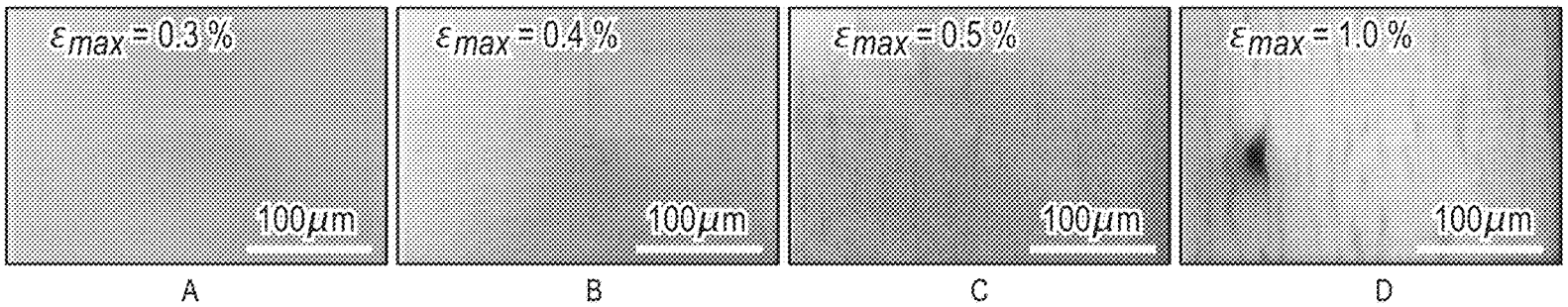
FIG. 5A is a magnified front view of surfaces (A-D) of a single oxide coating a specimen after being bent to different amounts of bending strain.
Figure 5B:
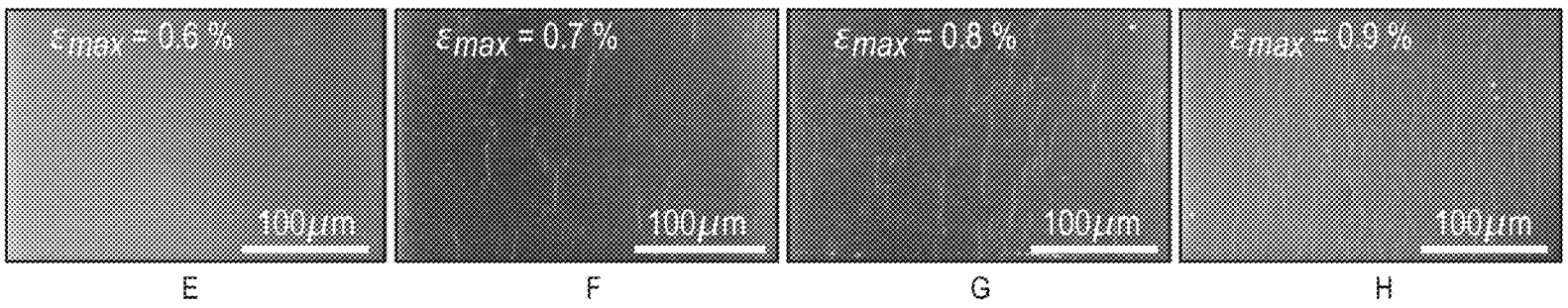
FIG. 5B is a magnified front view of surfaces (E-D) of a multilayer-coating that coats a specimen after being bent to different amounts of bending strain.

FIGS. 5A-5B show a comparison of cracking resistance between a single AO coating (FIG. 5A) and a quad-layer AO—Al—AO—Al coating (FIG. 5B), with a series of scanning electron microscope images on the coating surfaces after bending deformation to different degrees. In the single AO coating, which are illustrated by vertical lines in the images, cracks are observed when bending strain is over 0.4% (B, C, D), while in the quad-layer coating, shown in FIG. 5B, cracks are observed when bending strain is over 0.7% (F, G, H). The multi-layer coating of the present embodiments therefore can have a higher cracking resistance in bending deformation, as compared to conventional single material H-barrier coatings.

Figure 6B:
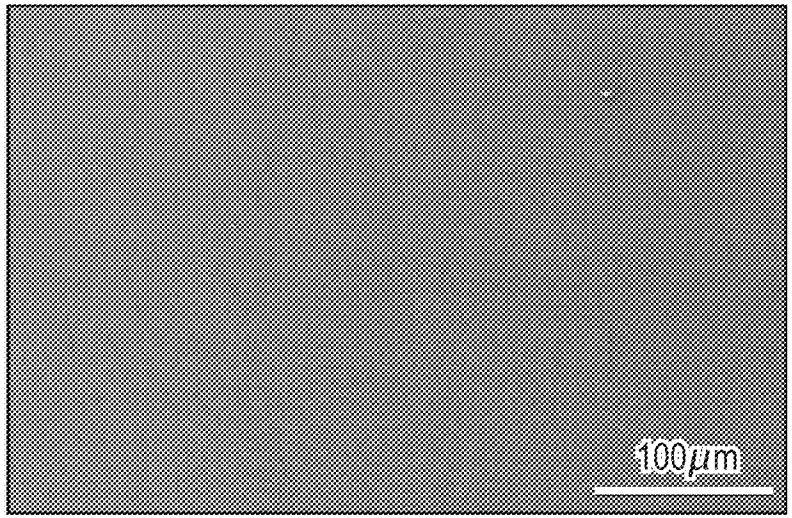
FIG. 6B is a magnified front view of a multi-layer coating surface after being bent to 1.0% bending strain.
Figure 6A:
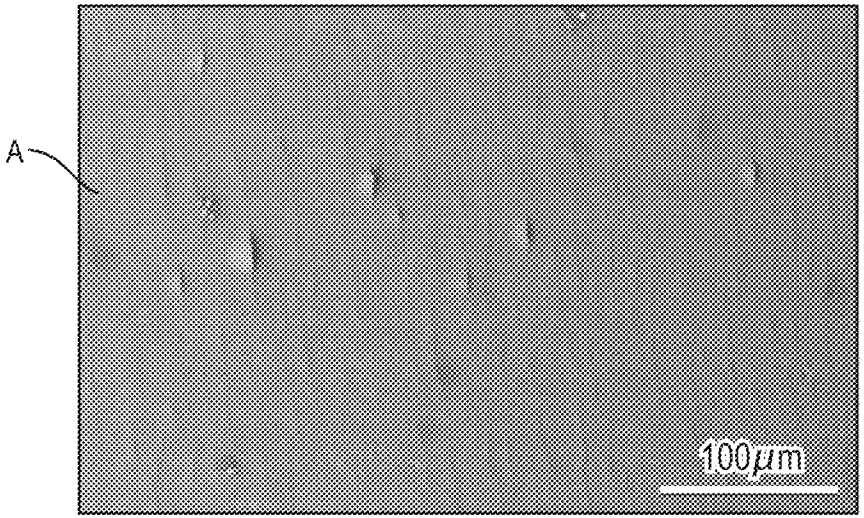
FIG. 6A is a magnified front view of a single oxide coating surface after being bent to 1.0% bending strain.

The multi-layer coating of metal and oxide layers can also exhibit improved resistance to coating delamination when the metal layer is applied as the first layer on the metal substrate. As shown in FIG. 6A, in the case of a single layer AO coating, coating delamination (A) is observed on the coating surface after bending deformation to 1.0% strain. In contrast, as shown in FIG. 6B, in the case of a quad-layer AO—Al—AO—Al coating, no delamination is observed even after bending deformation to 1.0% strain. The multi-layer coating of the present embodiments therefore can have a higher resistance to coating delamination, which can serve to prolong the life of the coated substrate beneath by shielding the substrate even under environment with mechanical attack in addition to hydrogen attack.

Examples of the above-described embodiments can include the following:

1. A method for regulating hydrogen permeability of a substrate, comprising:
   contacting a substrate with a metal under conditions sufficient to form a coated substrate comprising a coating of the metal on the substrate; and
   contacting the coated substrate with a metal oxide under conditions sufficient to form a coating of the metal oxide on the coated substrate, thereby forming a multilayer coating on the substrate.
2. The method of claim 1, further comprising:
   contacting the multilayered coating on the substrate with a second metal under conditions to form a coating on the multilayer coating; and
   contacting the second metal with a second metal oxide under conditions sufficient to form a coating of the second metal oxide on the second metal.
3. The method of any of claim 1 or claim 2, alternatively contacting the multilayered coating with a metal and a metal oxide to add alternating layers to the multilayered coating.
4. The method of any of claims 1 to 3, wherein contacting the substrate with the metal further comprises depositing the metal onto the substrate by one or more of thermal spray, cold spray, magnetron sputtering, sol-gel coating, chemical vapor deposition, slurry coating, spray-drying, atomic layered deposition, spin coating, or drop coating.
5. The method of any of claims 1 to 4, wherein contacting the coated substrate with the metal oxide further comprises depositing the metal oxide onto the coated substrate by one or more of thermal spray, cold spray, magnetron sputtering, sol-gel coating, chemical vapor deposition, slurry coating, spray-drying, atomic layered deposition, spin coating, or drop coating.
6. The method of any of claims 1 to 5, wherein the metal oxide is formed on the coated substrate by oxidizing the metal on the substrate.
7. The method of any of claims 1 to 6, wherein the metal oxide is aluminum oxide.
8. The method of any of claims 1 to 7, wherein the metal is aluminum.
9. The method of claim any of claims 1 to 8, further comprising expanding the substrate under temperature and pressure.
10. The method of any of claims 1 to 9, wherein the substrate is expanded by one or more of thermal heating of the substrate or stress application to the substrate.
11. The method of any of claim 1 or claim 10, wherein one or more layers of the multilayer coating includes at least one of cracks or pinholes extending therethrough, the at least one of cracks or pinholes terminating in the layer of the one or more layers.
12. The method of any of claims 1 to 11, wherein the multilayer coating includes one or more space-charge zones at the interfaces of the metal and the metal oxide.
13. A multilayer coating, comprising:
    a first layer containing a metal, the first layer configured to be deposited onto a substrate; and
    a second layer containing an oxide, the second oxide layer configured to be deposited onto the first metal layer,
    wherein the first and second layers form one or more space-charge zones at the interface thereof, the space-charge zones being configured to trap hydrogen molecules therein to prevent permeation of the molecules through the first layer.
14. The multi-layer coating of claim 13, wherein the metal oxide is aluminum oxide.
15. The multi-layer coating of claims 13 or claim 14, wherein the metal is aluminum.
16. The multi-layer coating of any of claims 13 to 15, wherein the multilayer coating comprises at least two layers of aluminum oxide and at least two layers of aluminum disposed in an alternating configuration.
17. The multi-layer coating of claim 16, wherein a first layer and a third layer of the multilayer coating includes aluminum, and a second layer and a fourth layer of the multilayer coating includes aluminum oxide.
18. The multi-layer coating of any of claims 13 to 17, wherein the first metal layer is configured to enter crevices formed in the substrate when deposited to increase adherence to the substrate.
19. The multi-layer coating of any of claims 13 to 18, wherein the combination of the first layer and the second layer are configured to decrease permeation of hydrogen through a thickness of the coating.
20. The multi-layer coating of any of claims 13 to 19, wherein one or more layers of the multi-layer coating includes cracks or pinholes therein, the cracks or pinholes terminating at the interfaces of the layer of the one or more layers.

One skilled in the art will appreciate further features and advantages of the disclosures based on the provided for descriptions and embodiments. Accordingly, the inventions are not to be limited by what has been particularly shown and described. All publications and references cited herein are expressly incorporated herein by reference in their entirety.

What is claimed is:

1. A method for regulating hydrogen permeability of a substrate, comprising:

contacting a substrate with a metal under conditions sufficient to form a coated substrate comprising a coating of the metal on the substrate; and contacting the coated substrate with a metal oxide under conditions sufficient to form a coating of the metal oxide on the coated substrate, thereby forming a multilayer coating on the substrate, wherein the multilayer coating includes one or more space-charge zones at interfaces of the metal and the metal oxide.

2. The method of claim 1, further comprising:

contacting the multilayered coating on the substrate with a second metal under conditions to form a coating on the multilayer coating; and contacting the second metal with a second metal oxide under conditions sufficient to form a coating of the second metal oxide on the second metal.

3. The method of claim 1, alternatively contacting the multilayered coating with a metal and a metal oxide to add alternating layers to the multilayered coating.

4. The method of claim 1, wherein contacting the substrate with the metal further comprises depositing the metal onto the substrate by one or more of thermal spray, cold spray, magnetron sputtering, sol-gel coating, chemical vapor deposition, slurry coating, spray-drying, atomic layered deposition, spin coating, or drop coating.

5. The method of claim 1, wherein contacting the coated substrate with the metal oxide further comprises depositing the metal oxide onto the coated substrate by one or more of thermal spray, cold spray, magnetron sputtering, sol-gel coating, chemical vapor deposition, slurry coating, spray-drying, atomic layered deposition, spin coating, or drop coating.

6. The method of claim 1, wherein the metal oxide is formed on the coated substrate by oxidizing the metal on the substrate.

7. The method of claim 1, wherein the metal oxide is aluminum oxide.

8. The method of claim 1, wherein the metal is aluminum.

9. The method of claim 1, further comprising expanding the substrate under temperature and pressure.

10. The method of claim 1, wherein the substrate is expanded by one or more of thermal heating of the substrate or stress application to the substrate.

11. The method of claim 1, wherein at least one layer of the one or more layers of the multilayer coating includes at least one of cracks or pinholes extending therethrough, the at least one of cracks or pinholes terminating in the at least one layer of the one or more layers.

12. A multilayer coating, comprising:

a first layer containing a metal, the first layer configured to be deposited onto a substrate; and a second layer containing an oxide, the second oxide layer configured to be deposited onto the first metal layer, wherein the first and second layers form one or more space-charge zones at an interface thereof, the space-charge zones being configured to trap hydrogen molecules therein to prevent permeation of the molecules through the first layer.

13. The multi-layer coating of claim 12, wherein the oxide is aluminum oxide.

14. The multi-layer coating of claim 12, wherein the metal is aluminum.

15. The multi-layer coating of claim 12, wherein the multilayer coating comprises at least two layers of aluminum oxide and at least two layers of aluminum disposed in an alternating configuration.

16. The multi-layer coating of claim 15, wherein a first layer and a third layer of the multilayer coating includes aluminum, and a second layer and a fourth layer of the multilayer coating includes aluminum oxide.

17. The multi-layer coating of claim 12, wherein the first metal layer is configured to enter crevices formed in the substrate when deposited to increase adherence to the substrate.

18. The multi-layer coating of claim 12, wherein the combination of the first layer and the second layer are configured to decrease permeation of hydrogen through a thickness of the coating.

19. The multi-layer coating of claim 12, wherein at least one layer of the one or more layers of the multi-layer coating includes cracks or pinholes therein, the cracks or pinholes terminating at the interfaces of the at least one layer of the one or more layers.

* * * * *